US007713360B2

(12) United States Patent
Ohashi

(10) Patent No.: US 7,713,360 B2
(45) Date of Patent: May 11, 2010

(54) RARE EARTH PERMANENT MAGNET

(75) Inventor: Ken Ohashi, Takefu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 888 days.

(21) Appl. No.: 11/062,961

(22) Filed: Feb. 22, 2005

(65) Prior Publication Data

US 2005/0189042 A1 Sep. 1, 2005

(30) Foreign Application Priority Data

Feb. 26, 2004 (JP) ..... 2004-050981
Feb. 26, 2004 (JP) ..... 2004-050982

(51) Int. Cl.
*H01F 1/053* (2006.01)

(52) U.S. Cl. ..... 148/303; 75/29; 75/38

(58) Field of Classification Search ..... None
See application file for complete search history.

(56) References Cited

U.S. PATENT DOCUMENTS

| | | | | | |
|---|---|---|---|---|---|
| 4,971,637 | A | * | 11/1990 | Ohashi et al. | 148/301 |
| 5,456,769 | A | * | 10/1995 | Sakurada et al. | 148/301 |
| 5,480,495 | A | * | 1/1996 | Sakurada et al. | 148/301 |
| 5,482,573 | A | * | 1/1996 | Sakurada et al. | 148/301 |
| 5,658,396 | A | | 8/1997 | Sakurada et al. | |
| 5,684,076 | A | * | 11/1997 | Takahashi et al. | 524/403 |
| 5,716,462 | A | * | 2/1998 | Sakurada et al. | 148/302 |
| 5,750,044 | A | | 5/1998 | Yoneyama et al. | |
| 5,769,969 | A | * | 6/1998 | Ishikawa et al. | 148/301 |
| 6,290,782 | B1 | | 9/2001 | Sakurada et al. | |
| 6,413,327 | B1 | * | 7/2002 | Okajima et al. | 148/301 |
| 2002/0011279 | A1 | | 1/2002 | Sakurada et al. | |
| 2002/0054825 | A1 | * | 5/2002 | Sukaki et al. | 420/83 |
| 2002/0129872 | A1 | * | 9/2002 | Ohashi | 148/103 |

FOREIGN PATENT DOCUMENTS

| | | |
|---|---|---|
| EP | 1 241 687 A1 * | 9/2002 |
| EP | 1 383 143 | 1/2004 |
| JP | 5-143972 | 6/1993 |
| JP | 08-045718 | 2/1996 |
| JP | 11 087119 | 3/1999 |
| JP | 2001-313206 | 11/2001 |
| JP | 2003-193208 | 7/2003 |

OTHER PUBLICATIONS

Lectard et al., "Saturation Magnetization and Anistropy Fields in the $SM(Co_{1-x}Cu_x)_5$ Phases," *J. Applied Physics*, vol. 75, No. 10, pp. 6277-6279, May 15, 1994.

Xiong et al., "Study on the Microstructure and Magnetic Properties of Rapidly Quenched $SM(Co_{1-x}Cu_x)_5$ Alloys," *Proc. 17th Int. Workshop on RE Magnets and Their Applications*, pp. 893-899, Aug. 2002.

Trammell, "Magnetic Ordering Properties of Rare-Earth Ions in Strong Cubic Crystal Fields," *Physical Review*, vol. 131, No. 3, pp. 932-948; Aug. 1, 1963.

European Search Report for 05251040.1 dated Jul. 15, 2005.

Halbach, "Design of Permanent Multipole Magnets With Oriented Rare Earth Cobalt Material," *Nuclear Instruments and Methods*, vol. 169, pp. 1-10, 1980.

Japanese Office Action for Appln. No. 2004-050981, dated Feb. 20, 1009 and Appln. No. 2004-050982, dated Feb. 20, 2009.

* cited by examiner

*Primary Examiner*—John P. Sheehan
(74) *Attorney, Agent, or Firm*—Alston & Bird LLP

(57) ABSTRACT

It is an object of the present invention to provide a permanent magnet which is observed as a uniform structure without microstructures, but shows a pinning type initial magnetization curve. There is provided a rare earth permanent magnet comprising a magnetic intermetallic compound comprising R, T, N and an unavoidable impurity, wherein R is one or more rare earth elements comprising Y, T is two or more transition metal elements and comprises principally Fe and Co; wherein the magnetic intermetallic compound has an T/R atomic ratio of 6 to 14; a magnetocrystalline anisotropy energy of at least 1 $MJ/m^3$; a Curie point of at least 100° C.; average particle diameter of at least 3 μm; and a substantially uniform structure; wherein the rare earth permanent magnet has a structure that gives a pinning-type initial magnetization curve; and wherein the magnetic intermetallic compound has a $Th_2Zn_{17}$-type structure, and the like.

4 Claims, 6 Drawing Sheets

RARE EARTH PERMANENT MAGNET

BACKGROUND OF THE INVENTION

1. Field of the Invention

The present invention relates to rare earth permanent magnets, and particularly relates to rare earth permanent magnets having a uniform structure. The rare earth permanent magnets according to the present invention are suitable for use in devices such as electronic apparatuses, motors and actuators for electrical devices, and synchronous motors which requires heat-resistance, position sensors for electrical devices and rotation sensors and the like.

2. Description of Related Art 2-17-type Sm—Co-based magnets, whose typical structure is, for example, $Sm(CoFeCuT)_{7.5}$, wherein T is Zr, Ti or the like, have high magnetic characteristics, excellent temperature characteristics, and corrosion-resistance, and are widely utilized as well as NdFeB-based magnets.

2-17-type Sm—Co-based magnets show a magnetic domain wall pinning type coercivity mechanism (FIG. 1*a*), and is different from 1-5 type Sm—Co-based magnets and NdFeB-based magnets, which show a nucleation growth type coercivity mechanism (FIG. 1*b*). Domain wall pinning magnets are magnets in which the magnetic moment of one phase of two separated phases is pinned at a number of locations throughout the domain wall minutely deposited between the phases, and therefore it is not possible to move the domain wall without applying a magnetic field of a specific value or more, resulting in that a large coercive force can be achieved. Such a characteristic can be seen from an initial magnetization curve as in FIG. 1A. It shows an initial magnetization curve such that, magnetization (M) does not increase unless an external magnetic field (H) of a specific value or more is applied, and that when magnetization starts to increase, the magnetization rapidly approaches saturation.

As shown in the photograph of FIG. 2, 2-17-type Sm—Co-based magnets have microstructures separated with coherency into two phases of a $Sm(CoCuFe)_5$ particle boundary phase, which is rich in Cu, and a $Sm_2(CoFeCu)_{17}$ phase, which is rich in Fe. Although the size of the microstructure varies depending on the composition, typically, the size of the 2-17 phase is from about several tens of nanometers to 300 nm, and the size of the 1-5 boundary phase that separates the 2-17 phase is generally 10 nm or less. From observation of the magnet with a Lorentz electron microscope (Lorentz TEM), it is said that domain walls are present in the 1-5 phase.

From the result of this observation, and the fact that there is a difference in domain wall energy between the 1-5 phase and the 2-17 phase, it is said that the domain wall is pinned to the 1-5 phase due to the difference in domain wall energy of the 1-5 phase and the 2-17 phase. Generally, the following formula is used to estimate the size of the coercive force Hci.

$$Hci=(\gamma_{2\text{-}17}-\gamma_{1\text{-}5})/Ms\delta$$

wherein γ is domain wall energy, Ms is saturation magnetization of the domain wall portion, and δ is width of the domain wall.

The pinning of the domain wall cannot be released, unless an external magnetic field having a value corresponding to the difference between the domain energies is applied. This corresponds to the coercive force. Consequently, with conventional understanding, it was said that a separated structure, non-uniform structure or deposition of impurities which generates a difference in the domain wall energy or a non-uniformity in the domain wall energy is essential for a domain wall pinning coercivity mechanism, and that without these, coercive force could not be obtained. It was generally considered that in the 2-17-type Sm—Co-based magnets it is realized by two-phase separation of the 2-17 phase and the 1-5 phase.

However, as opposed to the above described general understanding on the pinning type coercive force, although $Sm(CoCu)_5$, $Ce(CoCo)_5$ and $Ce(CoFeCu)_5$ magnets show initial magnetization curves of pinning type characteristics similar to 2-17-type Sm—Co-based magnets, no clear two-phase separation structure has been observed in these magnets. In some observations even using a transmission electron microscope (TEM), a two-phase separation structure has not been found in these magnets.

With regard to this, Lectard et al. theorized that the domain wall pinning is caused by concentration fluctuations of 10 nm or less, in other words, a state in which Co rich $Sm(CoCu)_5$ and Cu rich $Sm(CoCu)_5$ fluctuate on a micro scale, and the two phase separated structure can not be observed because the crystal structures are the same and there is very little difference in the lattice constants (see E. Lectard, C. H. Allibert, J. Applied Physics, 75 (1994), 6277., which is herein incorporated by reference.). This theory with regard to pinning type coercive force does not consider two-phase separation structures as the source of coercive force. However, it considers the differences in domain wall energy due to the concentration fluctuations as the source of the pinning type coercive force, and fundamentally, it is the same as conventional understanding on the matter.

SUMMARY OF THE INVENTION

The Hono group, which included the present inventors, analyzed the microstructure and concentration fluctuations of elements in a 1-5-type SmCo magnet into which Cu was added, in a region of 10 nm or less by the 3D atom probe method (see X. Y. Xiong, K. Hono, K. Ohashi and Y. Tawara, Proc. 17$^{th}$ Int. Workshop on RE Magnets and Their Applications, (2002), 893., which is herein incorporated by reference.). The analytical method is an useful analytical method in which mass is analyzed by applying a high voltage to the tip of a needle shaped magnet sample to strip off elements one by one, and it is possible to analyze the elements also regarding to their spatial distribution and to reconfigure their distribution. This has superior spatial resolution than observation by TEM. Consequently, with this analytical method, even the concentration fluctuations of elements on a scale of less than 10 nm can be observed. However, although with this analytical method the concentration distribution of Co and Cu was investigated in detail, distinct concentration fluctuations could not be found even at an atomic level. By this analytical result, the present inventor has come to the view that even in substantially uniform structure a pinning-type coercivity mechanism can exist.

The intrinsic pinning mechanism is known as a mechanism for obtaining coercive force not depending on two-phase separation and deposition. Regarding this mechanism, due to differences in the spin distribution at the atomic level, the thin domain walls are pinned at a number of locations, and thus coercive force is generated. For example, it was reported that $Dy_3Al_2$ has a coercive force of 20 kOe at the temperature of liquid helium, 4.2K (see G. T Trammuell, Physical Review, 131, (1963), p 932., which is herein incorporated by reference.). It is also reported that $Sm(Co_{0.5}Cu_{0.5})_5$ and $Sm(CoNi_{0.4})_5$ have high coercive force of 30 to 40 kOe at the temperature of liquid helium, 4.2K. However, coercive force based upon intrinsic pinning changes largely depending on temperature, and with an increase in temperature, the coercive force rapidly decreases.

From these observed results, it is considered that it is difficult to maintain effective coercive force based on conventional intrinsic pinning at room temperature, and that such a coercivity mechanism is a phenomenon observed only at low temperatures at which a thin domain wall width can be realized, and that it can not be applied to practical magnets used at room temperature and above. However, some problems had not been clearly analyzed, for example, what width of the domain wall can be quantitatively judged as thin, what degree of the magnetocrystalline anisotropy can be judged as sufficiently high, and whether the degree of the coercive force fluctuations depending on temperature is substantial problems of intrinsic pinning rather than dependents on the lowness of the Curie point.

It is an object of the present invention to provide a permanent magnet which is observed as a uniform structure without microstructures, but shows a pinning type initial magnetization curve.

In the present invention, based on the results of analysis of $Sm(CoCu)_5$, the present inventor has found a rare earth magnet that is uniform and has no microstructure and substantially no concentration fluctuations (at the nanometer scale and above), and that has a pinning type coercivity mechanism, other than $Sm(CoCu)_5$, leading to the present invention.

Specifically, according to the first embodiment of the present invention, there is provided a rare earth permanent magnet comprising a magnetic intermetallic compound comprising R, T, N and an unavoidable impurity, wherein R is one or more rare earth elements comprising Y, T is two or more transition metal elements and comprises principally Fe and Co;

wherein the magnetic intermetallic compound has an T/R atomic ratio of 6 to 14; a magnetocrystalline anisotropy energy of at least 1 $MJ/m^3$; a Curie point of at least 100° C.; average particle diameter of at least 3 μm; and a substantially uniform structure;

wherein the rare earth permanent magnet has a structure that gives a pinning-type initial magnetization curve; and wherein the magnetic intermetallic compound has a $Th_2Zn_{17}$-type structure.

In addition, according to the second embodiment of the present invention, there is provided a rare earth permanent magnet comprising a magnetic intermetallic compound comprising R, T and an unavoidable impurity, wherein R is one or more rare earth elements comprising Y, T is two or more transition metal elements and comprises principally Fe and Co;

wherein the magnetic intermetallic compound has an T/R atomic ratio of 6 to 14; a magnetocrystalline anisotropy energy of at least 1 $MJ/m^3$; a Curie point of at least 100° C.; average particle diameter of at least 3 μm; and a substantially uniform structure;

wherein the rare earth permanent magnet has a structure that gives a pinning-type initial magnetization curve; and wherein the magnetic intermetallic compound has a $TbCu_7$-type structure.

As described in detail below, the present invention provides a permanent magnet which is observed as a uniform structure without microstructures, but shows a pinning-type initial magnetization curve. A two-phase separated structure as described above in the background is formed by a complex heat treatment, and thus it is not possible to form the magnet simply by sintering. On the other hand, according to the present invention, a permanent magnet which is observed as a uniform structure without microstructures can be formed, and thus it is possible to form a magnet in a comparatively simple process without requiring complex heat treatments. Furthermore, by forming a permanent magnet that has a uniform structure without microstructures, since the coercivity mechanism of the uniform magnet is pinning type mechanism, it is possible to obtain a magnet whose coercive force fluctuations due to temperature are small.

DETAILED DESCRIPTION OF PREFERRED EMBODIMENTS

In the present application, the present inventor found that it is possible to develop a rare earth magnet that appears uniform and do not have microstructures but has a pinning coercivity mechanism, and there is provided a model of such a permanent magnet. The details are explained below.

Figure 3:
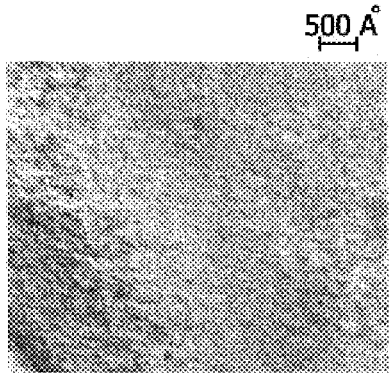
FIG. 3 shows photographs of microstructures of $Sm(CoCu)_5$ magnet observed by TEM (at approximately 110,000-fold magnification).

As described above, when $Sm(Co_{1-x}Cu_x)_5$ alloy ($0<x<0.5$) is observed by a TEM, a two-phase separated structure cannot be seen (FIG. 3). While concentration fluctuations of Co and Cu have not been observed, it is said that this is because their atomic numbers are similar. In view of this, the present inventor attempted to observe Co/Cu concentration fluctuations, by using a 3-D atom probe apparatus to perform element mapping at the atomic level. The 3D atom probe apparatus has the same basic construction as a field ion microscope (FIM), and it is a machine that measures the distribution of elements in actual three dimensional space at the atomic level by applying a high electrical field to the sample whose tip is sharpened, scraping off atoms from the tip, and then also measuring them with a mass analyzer or a 2D position sensitive detector that uses TOF.

Figure 4:
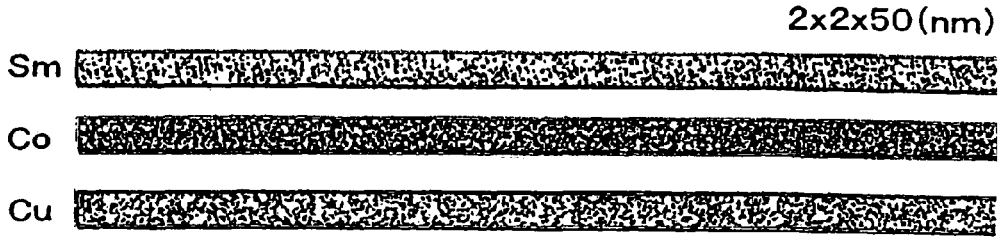
FIG. 4 shows the distribution of elements of the $Sm(CoCu)_5$ magnet measured by 3D atom probe apparatus.

The results of measuring the $Sm(CoCu)_5$ alloy by 3D atom probe apparatus are shown in FIG. 4, but despite observing the distribution at the atomic level, fluctuations in the Co/Cu concentration were not observed. By this observation, it was found that a domain wall pinning type coercivity mechanism can be obtained while the structure appears uniform.

Figure 5:
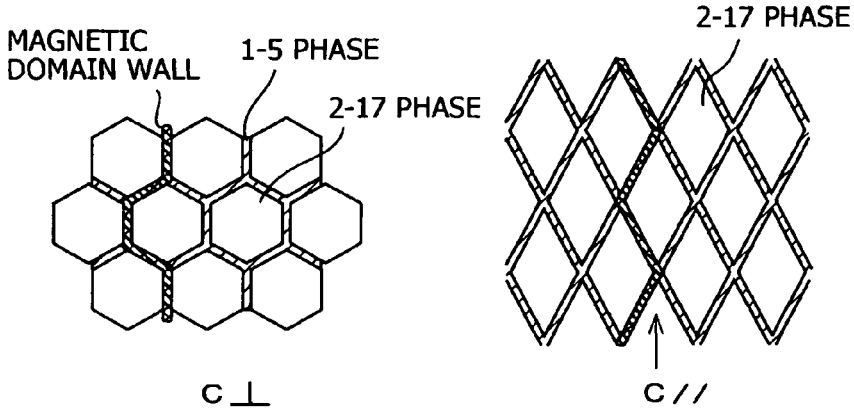
FIG.5 (RELATED ART)
FIG. 5 shows a schematic view of conventional domain wall pinning model in 2-17 type Sm—Co based magnets.

Conventionally, it was thought that in 2-17 type Sm—Co based magnets the domain wall was pinned to the 1-5 phase by the difference in domain wall energies of the two phases i.e. in 2-17 type Sm—Co based magnets, the 1-5 phase and the 2-17 phase (see FIG. 5). However, the conventional explanation contains an inconsistency. This is because the 1-5 boundary phase has a much larger magnetocrystalline anisotropy than the 1-17 principal phase, and therefore even if Co sites were substituted by Cu and its concentration increased, it is not possible that there would be a reversal of the crystalline magnetic anisotropy in the amount of Cu that is measured (about 20 atomic %). Despite this, from observation with a Lorentz TEM, it appears that the domain wall is pinned to the 1-5 phase. In the "model of domain wall energy difference" relating to coercive force, since the domain wall should be pinned to the phase that has the lower domain wall energy, the domain wall should actually be pinned to the 2-17 phase.

Although the conventional model contains the inconsistency as described above, if it is considered that the domain wall is intrinsically pinned to the 1-5 boundary phase then this inconsistency disappears. However, the 1-5 boundary phase in 2-17-type Sm—Co-based magnets has a very narrow width of 5 nm or less, and it is not possible to confirm this theory by actual measurement at the present time.

Regarding the mechanism by which the domain walls are pinned despite no existence of structure or fluctuations that prevent movement of the domain walls, the present inventor believes that the coercivity mechanism called intrinsic pinning can explain the coercive force of 1-5-type Sm—Co-based magnets. If the domain wall is very thin, it is no longer possible to handle the internal spin of the domain wall with the continuous body model. According to the intrinsic pinning model, the domain wall width and the domain wall energy fluctuate at the atomic level due to fluctuations of the internal spin of the domain wall. Thus the fluctuations at this atomic level prevent movement of the domain wall, and the coercive force is generated.

The reason why, conventionally, intrinsic pinning was not thought to be the cause of the generation of the coercive force was because the model was not thought to be suitable except in cases where it is at low temperatures and rare earth elements have a large magnetocrystalline anisotropy. However, $SmCo_5$ compounds have a very large magnetocrystalline anisotropy of 18 $MJ/m^3$ at room temperature, and $CeCo_5$ compounds, while smaller, have a magnetocrystalline anisotropy of 3 $MJ/m^3$. Differing depending on the measurer, the domain wall width of $SmCo_5$ lies within values of 2 to 5 nm, and this domain wall width corresponds to from 5 units to a little over 10 units of $SmCo_5$ unit cells. From the view point of the domain wall width, this number of units is not sufficiently thick, and it is necessary to treat them discretely. Consequently, intrinsic pinning may very well occur as the coercivity mechanism in this system.

The necessary conditions for intrinsic pinning are 1) a thin domain wall width and 2) fluctuations of the domain wall energy at the atomic level.

1) Since the theory regarding the quantitative thickness of a thin domain wall width has yet to be established, it cannot be stated definitively how thin the domain wall can be called a "thin domain wall width", but it is considered at approximately 10 nm or less, and the magnetocrystalline anisotropy is thought to be at least 1 to 2 $MJ/m^3$. Consequently, magnetic compounds capable of satisfying such conditions are substantially intermetallic compounds of rare earth-transition metals.

Furthermore, in order to satisfy 2) "fluctuations of the domain wall energy at the atomic level", it is necessary to increase the distribution of the domain wall energy represented by Formula 1 below.

$$\sigma_w = 4\sqrt{A(r)K(r)} \qquad \text{Formula 1}$$

wherein A(r) is a substitution constant (as a function of the location r), and K(r) is a magnetocrystalline anisotropy constant (as a function of the location r).

Since A(r) is principally determined by the transition metal and it is substantially determined by interaction between the two, the fluctuations can be largest when principally substituting transition metal sites with non-magnetic elements.

From such a point of view, a magnetic compound complex for which the intrinsic pinning model can be achieved, leading to the discovery of the following compound complex.

Namely, according to the first embodiment of the present invention, there is provided a rare earth permanent magnet comprising a magnetic intermetallic compound comprising R, T, N and an unavoidable impurity, wherein R is one or more rare earth elements comprising Y, T is two or more transition metal elements and comprises principally Fe and Co; wherein the magnetic intermetallic compound has an T/R atomic ratio of 6 to 14; a magnetocrystalline anisotropy energy of at least 1 $MJ/m^3$; a Curie point of at least 100° C.; average particle diameter of at least 3 μm; and a substantially uniform structure; wherein the rare earth permanent magnet has a structure that gives a pinning-type initial magnetization curve; and wherein the magnetic intermetallic compound has a $Th_2Zn_{17}$-type structure.

In addition, according to the second embodiment of the present invention, there is provided a rare earth permanent magnet comprising a magnetic intermetallic compound comprising R, T and an unavoidable impurity, wherein R is one or more rare earth elements comprising Y, T is two or more transition metal elements and comprises principally Fe and Co; wherein the magnetic intermetallic compound has an T/R atomic ratio of 6 to 14; a magnetocrystalline anisotropy energy of at least 1 $MJ/m^3$; a Curie point of at least 100° C.; average particle diameter of at least 3 μm; and a substantially uniform structure; wherein the rare earth permanent magnet has a structure that gives a pinning-type initial magnetization curve; and wherein the magnetic intermetallic compound has a $TbCu_7$-type structure.

The rare earth element R is a rare earth element wherein the rare earth element comprises Y. The transition element T comprised elements such as Co, Fe, Cu, Zr, Ti, V, Mo, Nb, W, Hf, Mn, Cr and the like. Here, "comprise principally Fe and Co", means that the total content of Fe and Co is at least 50 atomic % of the total amount of the transition metal element T. The unavoidable impurities comprise elements such as C, O, N and Si, and when they are comprised as impurities, their content is generally 1 wt % or less.

The "permanent magnet comprising a magnetic intermetallic compound" is a permanent magnet which comprises the compound in an amount of preferably at least 50 vol % or more, and may comprise material such as resin and rubber as other components.

It should be noted that the magnetic intermetallic compound has an T/R atomic ratio of 6 to 14. When T/R is less than 6, or greater than 14, the $TbCu_7$-type structure may not be stable.

It should be noted that the magnetic intermetallic compound has a magnetocrystalline anisotropy energy of at least 1 MJ/m$^3$. At this time, due to the intrinsic pinning mechanism, it is possible to configure a permanent magnet that has a uniform structure that has no microstructure but has a high coercive force. Furthermore, this is preferred because the larger the magnetocrystalline anisotropy energy becomes, it usually becomes easier to obtain a high coercive force from the intrinsic pinning mechanism.

Furthermore, the magnetic intermetallic compound has a Curie point of at least 100° C. When the Curie point is less than 100° C., changes in the magnetic properties caused by temperature and the loss of properties at high temperature may be large. Furthermore, the higher the Curie point, generally the loss of magnetic properties at high temperature is small, and this is preferable because the magnet is capable of use at high temperatures.

The rare earth permanent magnet according to the present invention may be applied to a bonded magnet and to a sintered magnet. When the rare earth permanent magnet according to the present invention is applied to a bonded magnet, the average particle diameter of the particles of the magnetic intermetallic compound (magnetic powder) is at least 3 μm, and is preferably 3 to 6 μm. Here, the "magnetic powder" is a powder obtained by crushing the alloy comprising R, T, N and an unavoidable impurity, wherein R is one or more rare earth elements comprising Y, T is two or more transition metal elements and comprises principally Fe and Co. It should be noted that when the average particle diameter of the magnetic powder is less than 3 μm, there may be disadvantages due to degradation of the characteristics of the micro powder by oxidation.

When the rare earth permanent magnet according to the present invention is applied to a sintered magnet, the average particle diameter of the sintered body-forming particles of the sintered body are at least 3 μm, and are preferably 3 to 6 μm. Here, the "sintered body" is a body that is obtained by sintering a molded body, which was obtained by a molding process in which magnetic powder is pressure molded within a magnetic field. The "sintered body-forming particles" are particles that originate from the magnetic powder, which form the sintered body. The average particle size of the sintered body-forming particles can be measured by observing the sintered body using a TEM.

Furthermore, the magnetic intermetallic compound has a substantially uniform structure. It is preferable that no microstructure of 1 nm or larger is present in the particles (magnetic intermetallic compounds). This means that the particles have a uniform structure to a degree at which the microstructure and concentration fluctuations cannot be observed even by TEM or 3D atom probe method.

It should be noted that as noted above, the "3D atom probe method" is a method for measuring the distribution of elements in actual three dimensional space at the atomic level, by applying a high electrical field to the sample whose tip is sharpened, scraping off atoms from that tip, and by measuring them with a mass analyzer or a 2D position sensitive detector that uses TOF. By this method it is possible to measure the distribution of the elements at the atomic level, i.e. to an accuracy of approximately 1 angstrom (0.1 nm).

Figure 1A:
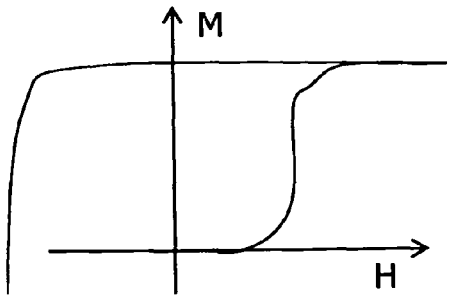
FIG. 1 shows graphs showing coercivity mechanisms of two types of rare earth permanent magnet; (a) a pinning type initial magnetization curve, and (b) a nucleation growth type initial magnetization curve.
Figure 1B:
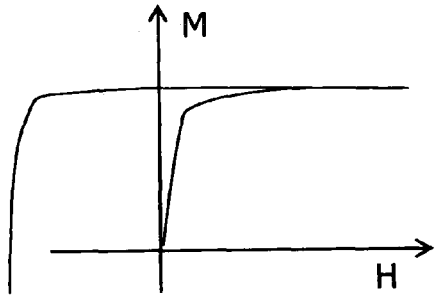
Figure 2A:
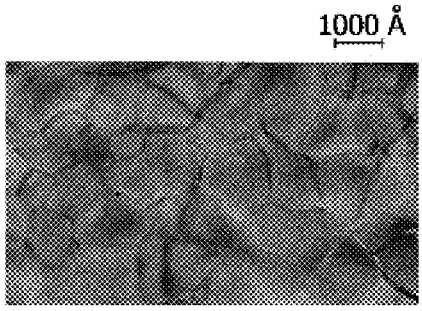
FIG.2(a) (RELATED ART)
FIG. 2 shows photographs of microstructures of prior 2-17-type Sm—Co-based magnets observed by TEM (at approximately 70,000-fold magnification).
Figure 2B:
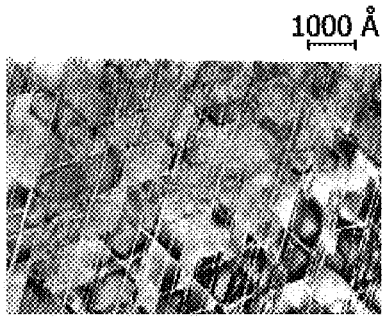
FIG.2(b) (RELATED ART)

Furthermore, the initial magnetization curve is a pinning-type curve. "The initial magnetization curve is a pinning-type curve" means that, as opposed to a nucleation growth type initial curve, as shown in FIG. 1A, an initial magnetization curve has the characteristics that the magnetization does not increase unless an external magnetic field of a specified value or more is applied, and that when the magnetization starts, it rapidly approaches saturation.

The nitrides, as represented by $Sm_2Fe_{17}N_x$, have large magnetocrystalline anisotropy, and they are well known as candidate material for permanent magnets. By crushing them down to the micron level, particularly to at most 3 to 4 μm, it is possible to obtain a practically significant coercive force. They are already in practical use as bonded magnets by providing the magnetic powder prepared as above as raw material of bonded magnets. The micro powder has no microstructure. The mechanism of the coercive force obtained by crushing the particles to the micron level, even if the particles are larger than a single magnetic domain particle diameter, is not well understood, but domain wall pinning in the vicinity of the particle surface is one candidate for the coercivity mechanism.

On the other hand, the nitride magnet according to the first embodiment of the present invention shows coercive force regardless of whether it is a micro powder or a bulk body such as a sintered body. That is to say, in nitrides that are observed as substantially uniform and as substantially single phase by X-ray diffraction, the domain walls are pinned at all points within the particles. One alloy of the magnet according to the present invention is an $R_2T_{17}N_x$ magnetic nitride obtained by nitriding an $R_2T_{17}$ compound that has a rhombohedral $Th_2Zn_{17}$ structure, wherein R is one or more rare earth elements comprising Y and comprises principally Sm, and T is one or more of Fe or Co, wherein the nitride compound is obtained by substituting some of element T for a transition metal element T', and wherein it is represented by Formula (I) below.

$$R'(T_{1-a}T'_a)_zN_x \qquad \text{Formula (I)}$$

wherein R' is one or more rare earth elements comprising Y and comprises principally Sm; T is one or more of Co or Fe; T' is one or more transition metal elements selected from a group comprising Zr, Ti, V, Mo, Nb, W, Hf, Mn, Ni, Cr and Cu; and a, z and x are numbers that satisfy $0.04 \leqq a \leqq 0.30$, $6 \leqq z \leqq 14$ and $1 \leqq x \leqq 3$, preferably z is a number that satisfies $8.0 \leqq z \leqq 9.0$.

Here, "R' . . . comprises principally Sm" means that with respect to the total amount of rare earth element R', the content of Sm is at least 50 wt %.

Figure 6A:
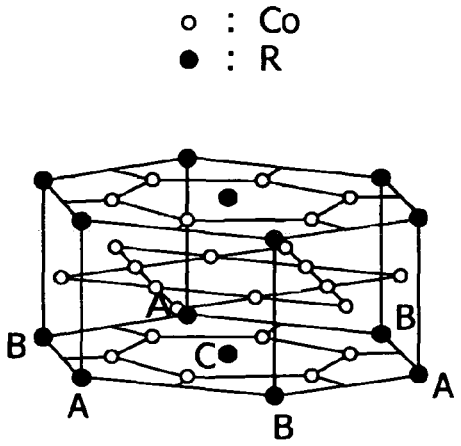
FIG.6(a) (RELATED ART)
FIG. 6*a* shows a schematic view of a crystal structure of $RCo_5$, hexagonal crystal.

$Th_2Zn_{17}$ structure is a structure given as follows. Namely, intermetallic compounds whose composition ratio of the rare earth element R, and Co, is 1:5 exist over a wide range of element R, and they take the hexagonal crystal based crystal structure that is known as the $CaCu_5$-type shown in FIG. 6A. This structure can be seen as having alternate layers of a lattice plane that includes a hexagonal lattice of Co, with R arranged in its center, and a 6-pointed star-shaped lattice of just Co. The positional relationships of the layers is such that the element R is in the center between the hexagonal figure created by the 6-pointed star-shaped lattice, and the hexagonal figure of the hexagonal lattice forms an angle of 30° with the hexagonal figure of the 6-pointed star-shaped lattice.

Figure 6B:
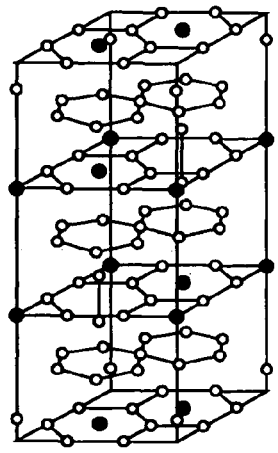
FIG.6(b) (RELATED ART)
FIG. 6*b* shows a schematic view of a crystal structure of $R_2Co_{17}$, rhombohedron.

The $R_2Co_{17}$ compound has a crystalline structure closely related to $RCo_5$ compounds. That is to say, $R_2Co_{17}$ may be obtained by removing one R from three $RCo_5$ unit cells, and inserting two Cos in its place. The pair of Co is arranged in a dumbbell shape along the c-axis, and the center of a line linking the Cos is the original position of the substituted R. There is a plurality of ways to substitute the R atom with the pair of Cos. By focusing only on the Rs in the basic $RCo_5$ lattice, the R sub-lattice is a simple hexagonal lattice which has triangular lattices accumulated into layers. The triangular lattices made by R are divided into three triangular sub-lattices labeled as A, B and C in FIG. 6A. One of these sub-lattices is substituted with a pair of Co atoms. When the substitution position of the Co pair is A, B, C, A, B, C along the c-axis, the structure becomes the rhombohedron that is known as the $Th_2Zn_{17}$-type of FIG. 6B.

Figure 6C:
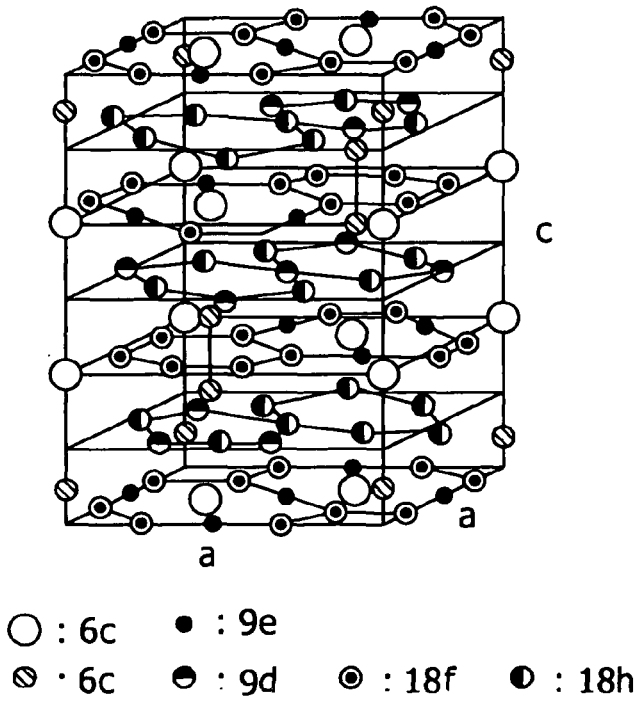
FIG.6(c) (RELATED ART)
FIG. 6*c* shows a schematic view of a crystal structure of $Th_2Zn_{17}$.

Among the $R_2Fe_{17}$, which is the rhombohedral $Th_2Zn_{17}$ compound, nitrides is exist in which nitrogen has penetrated between the lattices of the compound. The penetration location of N in these crystals is shown in FIG. 6C. The penetration locations, as shown in the diagram, are at octagonal sites shown as 9e in the spatial group symbols of the $Th_2Zn_{17}$ structure. As shown in the diagram, these are coplanar with the hexagonal lattice of Fe and the R atoms located in the center of that lattice, and in $R_2Fe_{17}$, three Ns are on sides of the hexagon surrounding an R. One side is shared by two Rs, and so the number of sites is 3/2 per R, being 3 per molecule. Consequently, a maximum of 3 Ns can be stored on a single molecule.

Moreover, $R_2Fe_{17}N_2$ can be synthesized by grinding $R_2Fe_{17}$ to a powder, and reacting with $N_2$ or $NH_3$ gas at high temperature. The degree of nitriding, i.e. the number of N atoms, differs with various reaction conditions. This is described as follows.

The magnet of the present invention can be micro ground and used as the magnetic powder for bonded magnets, and the powder can be arranged in a magnetic field and sintered to be used as a sintered magnet. However, when nitrides powder are sintered, the magnet decomposes into $RN_x$ and transition metals at a temperature of about 600° C. or more, thus after sintering the molding body to create the bulk body, it is possible to obtain a nitride sintered body by nitriding a thin sintered plate that has a thickness of 1 mm or less. With a sintered body having a thickness greater than this, it becomes difficult to achieve uniform nitriding through to the center.

By substituting the magnetic element T with the non-magnetic transition metal element T', the non-magnetic element can be introduced into the crystal at the atomic level. It is said that the non-magnetic transition element T' is substituted principally onto transition metal T dumbbell sites of 2-17 phase, and after the dumbbell sites are filled with the element T', the remaining sites are filled randomly. The alloy structure is not one that shows any particular structure due to the introduction of the element T', but is simply one whose structure is observed to be uniform. Even by TEM observation at the nanometer level, excluding twin boundaries (that do not affect domain wall pinning), no particularly special microstructure is observed. By substituting transition metal sites with non-magnetic transition metals, a significant coercive force may be obtained by the intrinsic pinning mechanism.

It should be noted that the content of T' is preferably 4 to 30 at % (at % is short for atomic %), and is more preferably 5 to 20 at %. When the substitution amount of element T' is 5 at % or less, the domain wall pinning effect may be low, and when it is 30 at % or more, it may not be preferable because reduction of the saturation magnetization and the Curie point is too large.

It should be noted that the content x of N is preferably 1 to 3. When x is less than 1, there may be the disadvantage that the magnetocrystalline anisotropy is small, and furthermore, as noted above, compounds that have the $Th_2Zn_{17}$ structure can contain a maximum of 3 Ns per single molecule.

Furthermore, it is preferable that the value of Z is 8 to 9. When the value of Z is at least 8 and at most 9, the rhombohedral $Th_2Zn_{17}$ structure is stable, and when Z is outside of this range, a stable single phase may not be obtained.

Basically, the element T' may be any transition metal other than Co and Fe that is capable of substituting onto transition metal sites to at least 4 at %. Elements other than transition elements, such as Al are capable of element T substitution to a certain extent, but it is possible that a sufficient substitution ratio may not be achieved.

Furthermore, in the second embodiment of the present invention, it is preferable that the composition formula of the intermetallic compound is represented by formula (II) given below.

$$R'(Co_{1-x-y-a}Fe_xCu_yT'_a)_z \qquad \text{Formula (II)}$$

wherein R' is one or more rare earth elements comprising Y and comprises principally Sm or Ce; T' is one or more transition metal elements selected from the group comprising Zr, Ti, V, Mo, Nb, W, Hf, Mn, Ni, Cr, Cu and Ni; and x, y, a and z are numbers that satisfy $0.05 \leqq x \leqq 0.30$, $0.15 \leqq y \leqq 0.35$, $0.001 \leqq a \leqq 0.05$ and $6 \leqq z \leqq 14$, preferably z is a number that satisfies $6.0 \leqq z \leqq 9.0$.

Here, "R' . . . comprises principally Sm or Ce" means that with respect to the total amount of rare earth element R', the total content of Sm and Ce is at least 50 wt %.

$R'(CoFeCuT')_z$ alloy, wherein $6.0 \leqq z \leqq 9.0$, and T' is one or more of elements such as Zr, Ti, V, Mo, Nb, W, Hf, Mn, Cr and Ni, has a $TbCu_7$ structure as a high temperature stable phase. The $TbCu_7$ structure is a structure like a rhombohedral $Sm_2Co_{17}$ structure in which Co dumbbell pairs are substituted into R sites at random, rather than regularly substituted as A, B, C, A, B, C.

Namely, differing from the rhombohedron known as the $Th_2Zn_{17}$-type, Furthermore, the structure known as the $TbCu_7$-type is provided by substituting R of the 1-5 compound at random onto Co pairs rather than into a specified position of R.

For example, 2-17 type Sm—Co based magnets that are practically used take the stable $TbCu_7$ structure in the sintering temperature region, or in the solution heat treatment temperature region that is slightly cooler than the sintering temperature region. An alloy that has a $TbCu_7$ phase at room temperature can be manufactured by rapidly cooling sintered bodies that are heated to the sintering temperature region or alloys that are heated up to the solution heat treatment temperature region, from the solution annealing temperature region.

Such 1-7 phase complexes have a magnetocrystalline anisotropy of at least 1 $MJ/m^3$ when R=Sm, and they are capable of substituting a suitable amount of Co sites with non-magnetic Cu. Of course, R may be two or more rare earths including Y and comprises principally Sm or Ce.

In 2-17-type SmCo-based magnets which is practically used, after sintering or solution heat treatment, 1-7 phases inevitably appear. Thus, there is the question of why, up to now, it was not found that coercive force can be achieved by a 1-7 phase.

It is because in the development of magnets for practical use, in order to increase the saturation magnetization and obtain a high $(BH)_{max}$, the composition was investigated only in the direction of reducing Cu and increasing Fe. Since high Cu containing regions, which appear to reduce the saturation magnetization, were deliberately not investigated, until the present invention no one managed to find that a pinning-type coercive force could be obtained with 1-7 phases themselves. Namely, in the room temperature region and the above, the present inventor has found a permanent magnet, other than a 1-5-based magnet, having a completely new intrinsic pinning mechanism.

By stabilizing the 1-7 phase with such alloy complexes, a coercive force of 800 kA/m or less can be obtained without sintering or heat treatment. Of course, in order to improve the magnetic properties, it is preferable to align the magnetic field to provide an anisotropic sintered magnet.

The Cu content is preferably 15 to 35 at % (at % means atomic %), and more preferably 15 to 30 at %. Substitution of Co with Cu is as expressed in the formula $R'(CoFeCuT')_z$, where at least 10 at %, and preferably at least 15 at % of the transition metal may be substituted. Substitution of Co with Cu at 10 at % or less may not give a sufficient coercive force. Furthermore, particularly in order to obtain a coercive force of 1.6 MA/m or greater, at least 25 at % Cu substitution is preferred. Since the saturation magnetization may decrease when too much Cu is substituted, it is preferable to stop the substitution at 35 at % in the given formula.

Furthermore, the Fe content is preferably 5 to 30 at %, and is more preferably 5 to 20 at %. Although the saturation magnetization increases with more Fe, at over 20 at %, the region in which the 1-7 phase is stable becomes narrow, and the Fe content is preferably 20 at % or less. At a content of 5 at % or less, the saturation magnetization may be too low, and thus it is preferable to be at least 5 at %.

Furthermore, the T' content is preferably 0.1 to 5 at %, and more preferably 1 to 5 at %. In order to stabilize the 1-7 phase, it is preferable that the amount of T' in the composition formula is at least 1 at %, and since the saturation magnetization may reduce too much when the content is 5 at % or more. In order to stabilize the 1-7 phase, it is possible to use a single transition metal element as T', and two or more transition metal elements may also be used.

Please note that the rest is Co.

Furthermore, the permanent magnet that includes the magnetic intermetallic compound according to the first embodiment of the present invention can, for example, be manufactured as follows. That is to say, when manufacturing a sintered magnet, it is possible to manufacture the permanent magnet according to the present invention with the steps of grinding an alloy comprising R, T, and an unavoidable impurity, wherein R is one or more rare earth elements comprising Y, T is two or more transition metal elements and comprises principally Fe and Co, to obtain a magnetic powder; pressure-molding the magnetic powder within a magnetic field to obtain a molded body; sintering the molded body to obtain a sintered body; and nitriding the sintered body. At this time, a high coercive force may be obtained even without performing aging to the sintered body.

In the step of crushing, the magnetic powder is obtained by crushing the alloy of the raw materials. It is possible to perform the crushing in a step-wise manner with changing tools. The first step may be "breaking", carried out by tools such as a stamp mill or a jaw crusher. In the second step, it is possible to "grind up" the particles by a device using the principle of a grinding mill, such as a Brown mill. By this, it is possible to obtain coarse particles of approximately a couple of hundred micrometers. These coarse particles are further finely ground to monocrystal particles having an average particle diameter that is preferably 2 to 10 μm, and more preferably 3 to 5 μm. For micro grinding, it is possible to use a ball mill or a jet mill. In jet milling, an inert gas such as $N_2$ is highly pressured and released through a narrow nozzle to generate a high speed gas flow, and the powdered particles are accelerated by this high speed gas flow. In the method, the particles are ground by applying a shock through impact of the powdered particles amongst themselves, or through impact with a target or the vessel wall.

In the step of molding, the magnetic powder obtained in the step of crushing is filled into a metal mold surrounded by electromagnets, and pressure molded while in a state in which the crystalline axes of the metal particles are aligned by application of a magnetic field. Preferably, the packing density of the micro powder is approximately 10 to 30% of the true density, and by molding in a magnetic field of 8 to 20 kOe at a pressure of about 0.5 to 2 ton/cm$^2$ it is possible to obtain a molded body whose molded density is about 30 to 50% of the true density. Although it is obvious that a high magnetic field is better, this is constrained by the fabrication limits of the electromagnet. If the packed density of the micro powder is increased, friction between particles may obstruct the above noted alignment, and the degree of alignment may be reduced. An organic-based lubricant may be used to improve the degree of particle alignment and the molded body density. Furthermore, it is also possible to use an organic-based binder to increase the strength of the molded body. Such organic materials may be the cause of oxidization or carbonization, and may adversely affect the characteristics of the magnet. In this case, before commencing sintering, it is possible to remove these compounds through decomposition and volatilization, preferably at about 100 to 300° C. This is known as "dewaxing". The applied direction of the magnetic field is naturally the ultimate direction in which the product needs to be polarized.

In the step of sintering, a sintered body is obtained by sintering the molded body that was obtained in the step of molding. Sintering is preferably performed in either a vacuum, or in an argon gas atmosphere. Sintering is preferably performed at 1100 to 1250° C. for 0.5 to 3 hours. This sintering temperature is a guide, and it is necessary to adjust this depending on various conditions such as the composition, crushing method, degree of particularity and the distribution of the degree of particularity, and the amount of material that is to be sintered at the same time.

In the step of nitriding, the sintered body obtained in the step of sintering is nitrided. Nitriding can be performed by reacting the sintered body with $N_2$ or $NH_3$ gas at high temperature. The degree of nitriding, i.e. the number of N atoms, will differ depending on various reaction conditions. The temperature at which nitriding is performed is preferably 300 to 600° C. Furthermore, the pressure at which nitriding is performed is preferably $10^4$ Pa to $10^6$ Pa. Furthermore, the time over which nitriding is performed, is preferably 10 min to 10 hours. It should be noted that as noted above, it is preferable to nitride thin sintered plates that have a thickness of 1 mm or less, after the molded body is sintered to make the bulk body.

It should be noted that the step of aging is a step for adjusting the coercive force, and refers to, for example, aging such as multi-step aging in which heat treatment is performed in a step-wise manner with sequentially lowering temperature; and double aging in which preliminary aging, which is performed by relatively rapid cooling to a relatively low temperature, is performed, followed by principal aging in which the magnet is maintained at a temperature of 800 to 900° C. and then slowly, continuously cooled. With the present invention, it is possible to configure a permanent magnet that has a high coercive force without aging, so there is no necessity to perform this step and the magnet can be fabricated by a simpler step.

Furthermore, when, for example, a bonded magnet is to be fabricated, it is possible to manufacture the permanent magnet according to the present invention by the steps of grinding an alloy comprising R, T, and an unavoidable impurity, wherein R is one or more rare earth elements comprising Y, T is two or more transition metal elements and comprises principally Fe and Co, to obtain a magnetic powder; nitriding the magnetic powder; and resin-molding and hardening the admixture of the magnetic powder mixed with a resin or the like.

The step of grinding and the step of nitriding can be performed in a similar manner to the case of the sintered magnet noted above. In the step of resin molding, a pellet raw material obtained by mixing or kneading magnetic powder, and resin or the like can be used. The material is molded by means such as compression, injection and extrusion, followed by hardening. In injection molding or extrusion molding, it is preferable to heat the pellets into a soft and fluid state, followed by hardening them by cooling. As the resin, it is preferable to use thermoset resin in pressure molding, and thermoplasticity resin in injection molding. For the former, epoxy-based resins, and for the latter, nylon-based resins can be principally used. For material such as resins, epoxy resins and the like are preferred. The amount of resin is preferably 50 vol % or less than the entire amount of the bonded magnet.

Furthermore, the permanent magnet that includes the magnetic intermetallic compound according to the second embodiment of the present invention can be manufactured as same as the permanent magnet that includes the magnetic intermetallic compound according to the first embodiment of the present invention, except that the step of nitriding is not necessary.

Example 1

An alloy was fabricated by weighing out 99.9% pure Sm, Co, Fe and Ti or V corresponding to $Sm(Fe_{res}Co_{0.20}Ti_{0.065})_{8.3}$ or $Sm(Fe_{res}Co_{0.20}V_{0.09})_{8.3}$; melting them in a high frequency furnace in a reduced pressure argon atmosphere; and casting in a water cooled mold. The alloy was micro ground to an average particle diameter of 4 μm in a jet mill using $N_2$ gas. While aligning the magnetic field of the micro powder in a magnetic field of 15 kOe, the particles were pressure molded at a pressure of 1 ton/cm$^2$ to provide a molded body. In an argon gas atmosphere, the molded body was sintered at 1210° C. for one hour, and sequentially followed by solution heat treatment at 1195° C. for two hours to fabricate a sintered body. Subsequently, the sintered body was cut into thin sintered plates having a thickness of 0.5 mm by cutting. The thin plates, and the alloy micro powder (powder of approximately 4 μm), were both maintained at a temperature of 500° C., with introduced $N_2$ gas and then nitrided under a nitrogen atmosphere at 10 atm. The nitrided sintered body and the micro powder were not subjected at all to aging heat treatment, as was performed on the 2-17 type SmCo-based magnet. From the weight increase ratio and wet composition analysis of the sintered body and the micro powder, the composition formulas are substantially expressed by $Sm(Fe_{res}Co_{0.20}Ti_{0.065})_{8.4}N_3$ or $Sm(Fe_{res}Co_{0.20}V_{0.09})_{8.4}N_3$, and both are sufficiently nitrided.

The hysteresis curve of both samples was measured by a BH tracer, and both showed a pinning-type initial magnetization curve. Both of the Ti substitution magnet had a coercive force of $H_{ci}$=5.5 kOe, and both of the V substitution magnet had a coercive force of $H_{ci}$=5.5 kOe. Furthermore, a part of the sintered body was used to perform powder X-ray diffraction, EPMA observation and TEM observation.

The peaks of the powder diffraction pattern by X-ray diffraction could be substantially indexed by the rhombohedral $Th_2Zn_{17}$ structure. Furthermore, from observation of the structure by EPMA, apart from a $Sm_2O_3$ oxide phase and a small amount of other phase deposition (although not identified, it was a non-magnetic phase from the magnetic domain pattern of the Kerr effect), the main magnetic phase showed substantially the same elemental distribution as the alloy composition, and no particular biases of specific elements and the like were observed. Even in photos enlarged 1 million times taken with TEM, no specific structure was found, and the magnets were uniform.

Example 2

An alloy was fabricated by weighing out 99.9% pure Sm, Co, Fe, Cu and Zr corresponding to $Sm(Co_{res}Fe_{0.20}Cu_{0.15}Zr_{0.025})_{7.5}$; melting them in a high frequency furnace in a reduced pressure argon atmosphere; and casting in a water cooled mold. The alloy was micro ground to an average particle diameter of 4 μm in a jet mill using $N_2$ gas. While aligning the magnetic field of the micro particles in a magnetic field of 15 kOe, the particles were pressure molded at a pressure of 1 ton/cm$^2$ to provide a molded body. In an argon gas atmosphere, the molded body was sintered at 1210° C. for one hour, and sequentially followed by, solution heat treatment at 1195° C. for two hours to fabricate a sintered body. Aging heat treatment, typically performed on the 2-17 SmCo-based magnet, was not performed at all.

Figure 7:
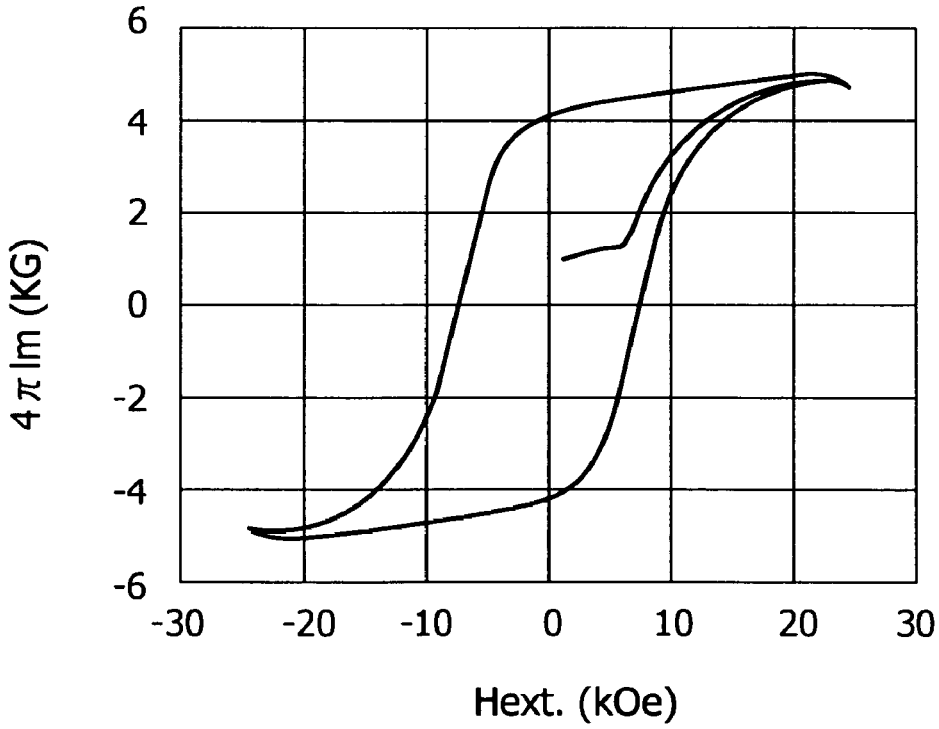
FIG. 7 shows a graph of hysteresis curve of the alloy according to one example of the present invention.

The hysteresis curve of the sintered body was measured by a BH tracer, and it showed a pinning-type initial magnetization curve, as shown in FIG. 7. It had a coercive force of $H_{ci}$=7.5 kOe. In FIG. 7, Hext represents the external magnetic field intensity, and 4πIm represents the magnetic flux density. Furthermore, a part of the sintered body was used to perform powder X-ray diffraction, EPMA observation and TEM observation.

Figure 8:
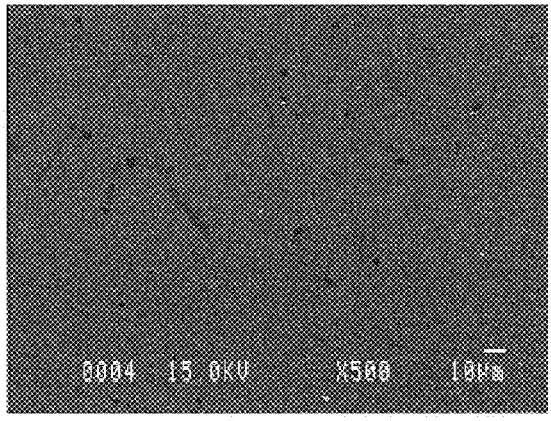
FIG. 8 shows a second order electron image of the alloy according to one example of the present invention, by using EPMA (at approximately 300-fold magnification).
Figure 9:
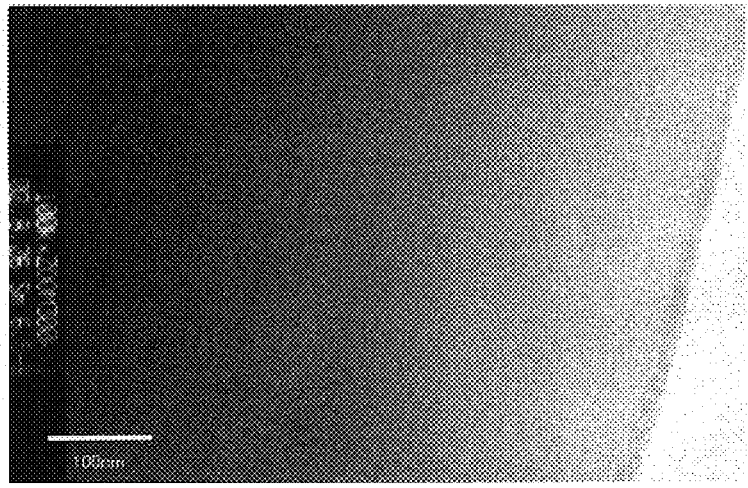
FIG. 9 shows a photo of enlarged structure of the alloy according to one example of the present invention, by using TEM (at approximately 15,000-fold magnification).

The peaks of the diffraction pattern by X-ray diffraction could be completely indexed by the $TbCu_7$ structure, and the fine, sharp shape of the peaks also indicated that the 1-7 phase was stable. Furthermore, from observation of the structure by EPMA, the alloy composition of the principal magnetic phase showed substantially the same elemental distribution, and no particular biases of specific elements and the like were observed. FIG. 8 shows a second order electron image (composition image). Apart from a $Sm_2O_3$ oxide phase and a few ZrCo phases, shading that indicates difference of concentration was not observed. While FIG. 9 is a 1 million times enlarged photo taken with TEM, no specific microstructure was found. Although a border exists between both crystals, since this expands only in the direction of the C plane direction, it is not affect on coercive force and therefore the structure is uniform.

From these observation results, it was found that despite the magnetic sintered body having no microstructure, it was a magnet having a pinning type coercivity mechanism. As is obvious, it should be noted the composition of the present invention is not limited to that of the present embodiment.

The invention claimed is:

1. A rare earth permanent magnet comprising a magnetic intermetallic compound comprising R, T and an unavoidable impurity, wherein R is one or more rare earth elements, T is three or more transition metal elements and comprises principally Fe, Cu and Co;

wherein the magnetic intermetallic compound has an T/R atomic ratio of 6 to 14; a magnetocrystalline anisotropy energy of at least 1 MJ/m$^3$; a Curie point of at least 100° C.; average particle diameter of at least 3 μm;

wherein the rare earth permanent magnet has a structure that gives a pinning initial magnetization curve and lacks microstructure of 1 nm or above inside the magnetic intermetallic compound;

wherein no less than 25 to 35 atomic % of the transition metal T content is replaced by Cu; and wherein the magnetic intermetallic compound has a $TbCu_7$ structure, and wherein the intermetallic compound has a composition formula:

$$R'(Co_{1-x-y-a}Fe_xCu_yT'_a)_z \quad \text{Formula (II)}$$

wherein R' is one or more rare earth elements comprising Y and comprises principally Sm or Ce; T' is one or more transition metal elements selected from the group consisting of Zr, Ti, V, Mo, Nb, W, Hf, Mn, Cr, and Ni; and x, y, a and z are numbers that satisfy $0.05 \leqq x \leqq 0.30$, $0.25 \leqq y \leqq 0.35$, $0.001 \leqq a \leqq 0.05$ and $6 \leqq z \leqq 14$.

2. The rare earth magnet according to claim 1, wherein the magnetic intermetallic compound is of sintered body-forming particles.

3. The rare earth permanent magnet according to claim 1, wherein z is a number that satisfies $6.0 \leqq z \leqq 9.0$.

4. A rare earth permanent magnet comprising a magnetic intermetallic compound comprising R, T and an unavoidable impurity, wherein R is one or more rare earth elements, T is three or more transition metal elements and comprises principally Fe, Cu and Co;

wherein the magnetic intermetallic compound has an T/R atomic ratio of 6 to 14; a magnetocrystalline anisotropy energy of at least 1 $MJ/m^3$; a Curie point of at least 100° C.; average particle diameter of at least 3 μm;

wherein the rare earth permanent magnet has a structure that gives a pinning initial magnetization curve and lacks microstructure of 1 nm or above inside the magnetic intermetallic compound;

wherein no less than 25 to 35 atomic % of the transition metal T content is replaced by Cu; and wherein the magnetic intermetallic compound has a $TbCu_7$ type structure, and wherein the intermetallic compound has a composition formula:

$$R'(Co_{1-x-y-a}Fe_xCu_yT'_a)_z \quad \text{Formula (II)}$$

wherein R' is one or more rare earth elements comprising Y and comprises principally Sm or Ce; T' is one or more transition metal elements selected from the group consisting of Zr, Ti, V, Mo, Nb, W, Hf, Mn, Cr, and Ni; and x, y, a and z are numbers that satisfy $0.05 \leqq x \leqq 0.30$, $0.25 \leqq y \leqq 0.35$, $0.001 \leqq a \leqq 0.05$ and $6 \leqq z \leqq 14$.

* * * * *